US010260386B2

(12) United States Patent
Andrisani et al.

(10) Patent No.: US 10,260,386 B2
(45) Date of Patent: Apr. 16, 2019

(54) SELF-RETRACTING HYDRAULIC ENGINE BRAKE SYSTEM

(71) Applicant: Eaton SRL, Milan (IT)

(72) Inventors: Nicola Andrisani, Cumiana (IT); Alessio Courtial, Turin (IT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/562,445

(22) PCT Filed: Mar. 7, 2016

(86) PCT No.: PCT/EP2016/054747
§ 371 (c)(1),
(2) Date: Sep. 28, 2017

(87) PCT Pub. No.: WO2016/155978
PCT Pub. Date: Oct. 6, 2016

(65) Prior Publication Data

US 2018/0087412 A1 Mar. 29, 2018

(30) Foreign Application Priority Data

Mar. 31, 2015 (GB) ..... 1505583.3

(51) Int. Cl.
*F01L 13/00* (2006.01)
*F01L 13/06* (2006.01)
(Continued)

(52) U.S. Cl.
CPC ..... *F01L 13/065* (2013.01); *F01L 1/18* (2013.01); *F01L 13/06* (2013.01); *F02D 13/04* (2013.01)

(58) Field of Classification Search
CPC . F01L 13/065; F01L 13/06; F01L 1/18; F02D 13/04
See application file for complete search history.

(56) References Cited

U.S. PATENT DOCUMENTS

2010/0065019 A1* 3/2010 Yang ..... F02D 13/04 123/321
2010/0170472 A1* 7/2010 Yang ..... F01L 1/08 123/321
(Continued)

FOREIGN PATENT DOCUMENTS

CN 101672206 A 3/2010
CN 102003242 A 4/2011
(Continued)

*Primary Examiner* — Hieu T Vo
*Assistant Examiner* — Sherman Manley
(74) *Attorney, Agent, or Firm* — Leydig, Voit & Mayer, Ltd.

(57) ABSTRACT

An exhaust valve rocker arm assembly operable in a combustion engine mode and an engine braking mode includes: a rocker shaft defining a pressurized oil supply conduit; a rocker arm that receives the rocker shaft and rotates around the rocker shaft, the rocker arm having an oil supply passage therein; a valve bridge that engages a first exhaust valve at a first foot and a second exhaust valve at a second foot; and a capsule assembly disposed on the rocker arm having a capsule body that moves between first and second capsule positions, wherein, in the first capsule position, the capsule body is in a retracted position in the rocker arm offset from the valve bridge, wherein, in the second capsule position, the capsule body extends rigidly for cooperative engagement with the valve bridge.

19 Claims, 9 Drawing Sheets

(51) Int. Cl.
*F01L 1/18* (2006.01)
*F02D 13/04* (2006.01)

(56) References Cited

U.S. PATENT DOCUMENTS

| | | | | |
|---|---|---|---|---|
| 2013/0269652 | A1* | 10/2013 | Toth | F01L 1/181 123/323 |
| 2013/0319370 | A1* | 12/2013 | Yang | F01L 1/08 123/322 |
| 2014/0083381 | A1* | 3/2014 | Roberts | F01L 1/08 123/90.15 |
| 2014/0182536 | A1* | 7/2014 | Yang | F01L 1/181 123/90.39 |
| 2015/0144096 | A1* | 5/2015 | Meneely | F01L 1/18 123/321 |
| 2016/0281612 | A1* | 9/2016 | Toth | F01L 13/065 |
| 2016/0356187 | A1* | 12/2016 | Meneely | F01L 13/06 |
| 2017/0276035 | A1* | 9/2017 | Cecur | F01L 13/06 |
| 2017/0321576 | A1* | 11/2017 | Nielsen | F01L 1/2416 |
| 2018/0209309 | A1* | 7/2018 | VanWingerden | F02D 13/0203 |

FOREIGN PATENT DOCUMENTS

| | | | |
|---|---|---|---|
| DE | 102013215946 | A1 | 2/2015 |
| EP | 2677127 | A1 | 12/2013 |
| WO | WO 2015120897 | A1 | 8/2015 |

* cited by examiner

SELF-RETRACTING HYDRAULIC ENGINE BRAKE SYSTEM

CROSS-REFERENCE TO PRIOR APPLICATIONS

This application is a U.S. National Phase application under 35 U.S.C. § 371 of International Application No. PCT/EP2016/054747, filed on Mar. 7, 2016, and claims benefit to Great Britain Patent Application No. 1505583.3, filed on Mar. 31, 2015. The International Application was published in English on Oct. 6, 2016 as WO 2016/155978 under PCT Article 21(2).

FIELD

The present disclosure relates generally to a rocker arm assembly for use in a valve train assembly and more particularly to a rocker arm assembly that provides a compression brake function.

BACKGROUND

Decompression engine brakes can be used as auxiliary brakes, in addition to wheel brakes, on relatively large vehicles, for example trucks, powered by heavy or medium duty diesel engines. A decompression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

In a typical valve train assembly used with a decompression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. Decompression engine brake systems can be based on an actuation capsule, assembled on the rocker body and directly acting on the valves or the valve bridge. For such systems, the cam is usually designed with a total shape, resulting from the sum of the engine brake lift and the normal valve opening (that used for positive power mode). The total cam lift is then provided with an additional closing ramp, to let the valve train back from brake lift to base circle.

During positive power mode, a dedicated lost motion system excludes the engine brake lift, so only a net valve lift (i.e. normal valve opening) is provided. On brake mode, with a proper actuation pressure level (such as may be regulated by a solenoid valve), the capsule may assume a designed working position, in order to exclude the lost motion system and modify the lift shape of exhaust valves, thus anticipating the valve opening and enabling cylinder decompression.

When the capsule is enabled for engine braking, a late closing of braking valves may occur because of residual cam closing ramp extension, which is usually hidden by the lost motion system during positive power mode. Late valve closing during engine braking is usually tolerated, as the exhaust closing stage has a relatively low impact on the braking power. For engine configurations provided with a floating bridge on two exhaust valves, and being designed to use only one valve for braking (in order to reduce the pressure load on the valve train by half), on anticipated opening only one valve moves, while the other is kept closed. As a consequence, the bridge tilts proportionally to the brake valve lift, until the lost motion of the system is completely recovered.

Such behavior is desirable at opening, while a closing delay of brake valve should be avoided, as the two valves should be desired to close at the same time and at the designed speed. Alternatively, if the bridge tilts also at closing stage (for example because of the engine brake capsule still expanded or difficult to compress), the engine brake valve closes last and normally seats, while the slave valve (that closes first) comes to the seat insert at a double velocity with respect to design with subsequent risks of failure at long durability. It is desirable to provide a system where both exhaust valves correctly close.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

In an embodiment, the present invention provides an exhaust valve rocker arm assembly operable in a combustion engine mode and an engine braking mode, the exhaust valve rocker arm assembly comprising: a rocker shaft that defines a pressurized oil supply conduit; a rocker arm that receives the rocker shaft and is configured to rotate around the rocker shaft, the rocker arm having an oil supply passage defined therein; a valve bridge that engages a first exhaust valve at a first foot and a second exhaust valve at a second foot; a capsule assembly disposed on the rocker arm having a capsule body that is configured to move between a first capsule position and a second capsule position, wherein in the first capsule position, the capsule body is in a retracted position in the rocker arm offset from the valve bridge, wherein in the second capsule position, the capsule body extends rigidly for cooperative engagement with the valve bridge; a pulling spring configured to normally bias the capsule body to the retracted position; and a shift assembly disposed in the capsule assembly and having a shift body configured to move between first and second shift positions, the first shift position corresponding to the capsule body in the first capsule position, the shift body having a shift body chamber that houses a check ball valve assembly, the shift body configured to move from the first shift position to the second shift position in engine brake mode upon opening of the check ball valve assembly, wherein, in the engine braking mode, pressurized oil is communicated through the oil supply passage and against the shift body such that the shift body moves from the first shift position to the second shift position.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
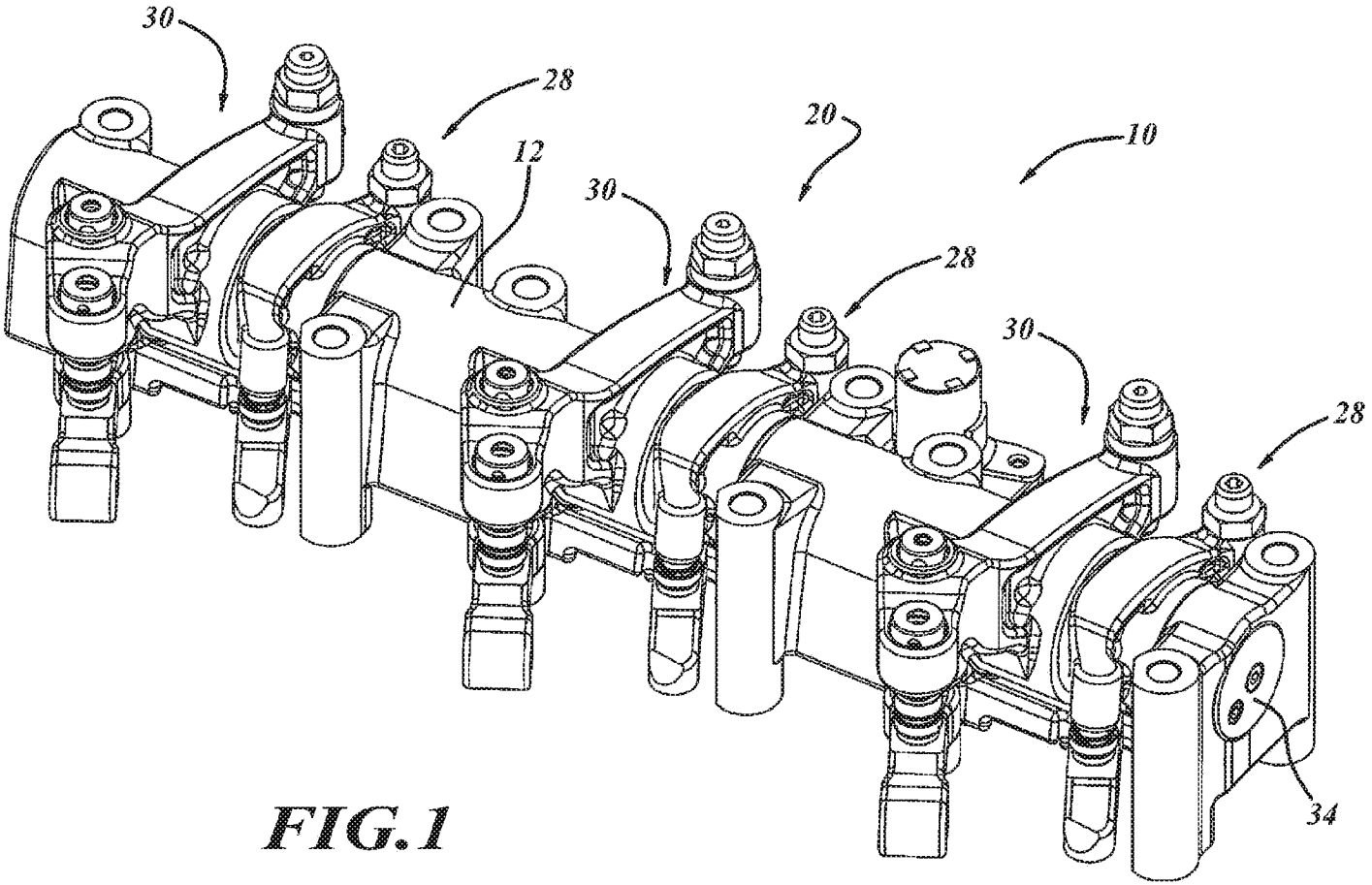
FIG. 1 is a perspective view of a partial valve train assembly incorporating a rocker arm assembly including an exhaust valve rocker arm assembly for use with compression engine braking and constructed in accordance to one example of the present disclosure.

An exhaust valve rocker arm assembly operable in a combustion engine mode and an engine braking mode includes a rocker shaft, a rocker arm, a valve bridge, a capsule assembly, a pulling spring and a shift assembly. The rocker shaft defines a pressurized oil supply conduit. The rocker arm receives the rocker shaft and is configured to rotate around the rocker shaft. The rocker arm has an oil supply passage defined therein. The valve bridge can engage a first exhaust valve at a first foot and a second exhaust valve at a second foot. The capsule assembly can be disposed on the rocker arm and have a capsule body that moves between a first capsule position and a second capsule position. In the first capsule position, the capsule body is in a retracted position in the rocker arm offset from the valve bridge. In the second capsule position, the capsule body extends rigidly for cooperative engagement with the valve bridge. The pulling spring normally biases the capsule body to the retracted position. The shift assembly is disposed in the capsule assembly and has a shift body that moves between first and second shift positions. The shift body has a shift body chamber that houses the check ball valve assembly. The shift body is configured to move from the first shift position to the second shift position in engine brake mode upon opening of the check ball valve assembly. In the engine braking mode, pressurized oil is communicated through the oil supply passage and against the shift body such that the shift body moves from the first shift position to the second shift position.

According to additional features, the capsule body extends between a capsule ball end and a stem end. The capsule body can define a shift assembly pocket that receives the shift assembly therein. The capsule body can further define (i) a capsule channel that extends from the shift assembly pocket to an outer surface of the capsule body, and (ii) a capsule ball end passage that extends from the shift assembly pocket to an outer surface of the capsule body. The check ball valve assembly can include a check ball and a check valve spring. The check ball can be urged against a valve seat surface provided around a port on the shift body by the check valve spring.

According to other features, upon opening of the check ball assembly, the check ball is moved off of the valve seat and oil flows through the port and into the capsule channel and the capsule ball end passage. Oil pressure acting on an outer surface of the shift body proximate the port urges the shift body to move from the first shift position to the second shift position. The capsule body can further define a leakage channel that extends from the shift assembly pocket to an outer surface of the capsule body. When the shift body is in the first shift position, low pressure oil acting in the shift body chamber exits through the leakage channel. The exhaust valve rocker arm can further include a spigot assembly having a spigot body that extends through a passage formed through the rocker arm. The spigot body is biased into engagement with the valve bridge and is permitted to translate along an axis thereof within the passage.

An exhaust valve rocker arm assembly operable in a combustion engine mode and an engine braking mode and constructed in accordance to another example of the present teachings includes a rocker shaft, a rocker arm, a valve bridge, a capsule assembly and a shift assembly. The rocker shaft defines a pressurized oil supply conduit. The rocker arm receives the rocker shaft and is configured to rotate around the rocker shaft. The rocker arm has an oil supply passage defined therein. The valve bridge engages a first exhaust valve at a first foot and a second exhaust valve at a second foot. The capsule assembly is disposed on the rocker arm and has a capsule body that moves between a first capsule position and a second capsule position. In the first capsule position, the capsule body is in a normally retracted position in the rocker arm and offset from the valve bridge. In the second capsule position, the capsule body extends rigidly for cooperative engagement with the valve bridge.

The shift assembly is disposed in the capsule assembly and includes a shift body, a check ball and a return spring. The shift body moves between first and second shift position. The first shift position corresponds to the capsule body in the first capsule position. The shift body has a shift body chamber. The check ball assembly is received in the shift body chamber. The shift body is configured to move from the first shift position to the second shift position in engine brake mode upon opening of the check ball valve assembly. The return spring biases the shift body toward the first shift position. In the engine braking mode, pressurized oil is communicated through the oil supply passage and against the shift body such that the shift body moves from the first shift position to the second shift position.

According to additional features, the exhaust valve rocker arm assembly includes a pulling spring that normally biases the capsule body to the retracted position. The capsule body extends between a capsule ball end and a stem end. The capsule body defines a shift assembly pocket that receives the shift assembly therein. The capsule body further defines (i) a capsule channel that extends from the shift assembly pocket to an outer surface of the capsule body, and (ii) a capsule ball end passage that extends from the shift assembly pocket to an outer surface of the capsule body.

According to still other features, the check ball valve assembly includes a check ball and a check valve spring. The check ball can be urged against a valve seat surface provided around a port on the shift body by the check valve spring. The shift body defines a shift body recirculation groove that leads to a first passage and a second passage extending into a shift body chamber. The capsule channel, the first passage, the second passage and the capsule ball end passage are all fluidly connected. Oil pressure acting on an outer surface of the shift body proximate the port urges the shift body to move from the first shift position to the second shift position. Upon opening of the check ball assembly, the check ball is moved off of the valve seat and oil flows through the port and into the capsule channel and the capsule ball end passage.

According to other features, the capsule body further defines a leakage channel that extends from the shift assembly pocket to an outer surface of the capsule body. When the shift body is in the first shift position, low pressure oil acting in the shift bod chamber exits through the leakage channel. The exhaust valve rocker arm can further include a spigot assembly having a spigot body that extends through a passage formed through the rocker arm. The spigot body is biased into engagement with the valve bridge and is permitted to translate along an axis thereof within the passage.

As will be described in detail below, the present disclosure provides an engine brake capsule designed to be normally compressed. Such a configuration influences both exhaust valves to correctly close. Expansion of the capsule depends both on the control pressure level and its contact with the valve bridge. During a normal power mode event, the capsule is designed for being normally collapsed in order to avoid the contact with the valve bridge during a valve event. During an engine brake event, the capsule is able to expand in order to provide the full braking event and, once the contact with the bridge is missed, it collapses in order to remove any obstacle to the valve closing event.

With initial reference to FIG. 1, a partial valve train assembly constructed in accordance to one example of the present disclosure is shown and generally identified at reference 10. The partial valve train assembly 10 utilizes engine braking and is shown configured for use in a three-cylinder bank portion of a six-cylinder engine. It will be appreciated however that the present teachings are not so limited. In this regard, the present disclosure may be used in any valve train assembly that utilizes engine braking.

The partial valve train assembly 10 can include a rocker assembly housing 12 that supports a rocker arm assembly 20 having a series of intake valve rocker arm assemblies 28 and a series of exhaust valve rocker arm assemblies 30. A rocker shaft 34 is received by the rocker assembly housing 12. As will be described in detail herein, the rocker shaft 34 cooperates with the rocker arm assembly 20 and more specifically to the exhaust valve rocker arm assemblies 30 to communicate oil to the exhaust valve rocker arm assemblies 30 during engine braking.

Figure 2:
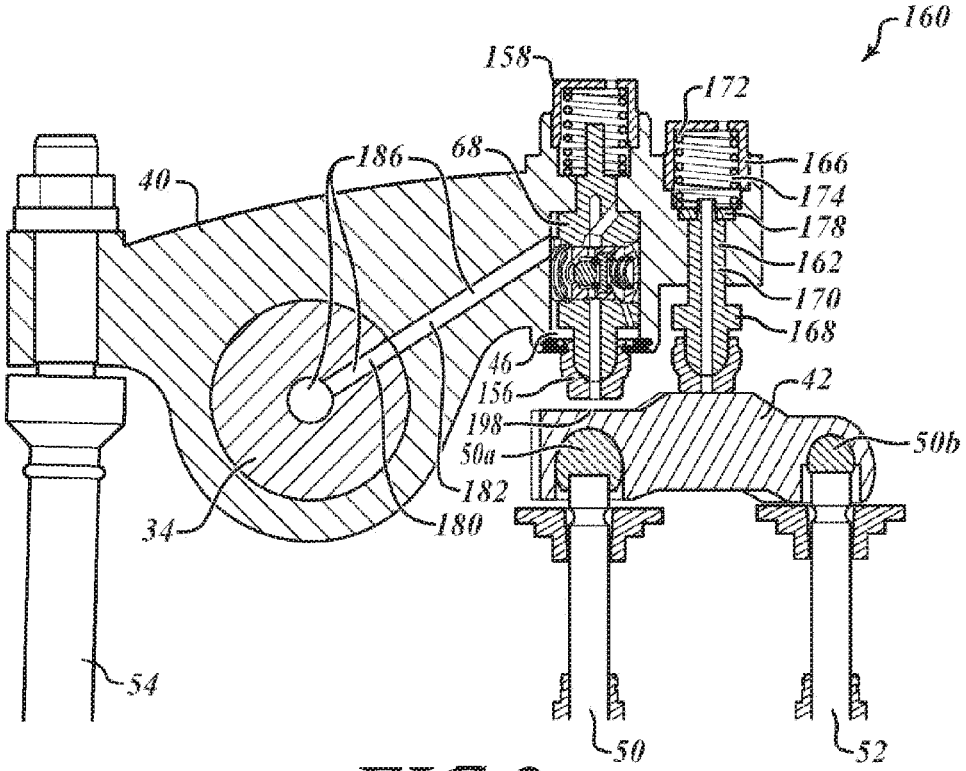
FIG. 2 is sectional view of an exhaust valve rocker arm assembly of the valve train assembly of FIG. 1.
Figure 3:
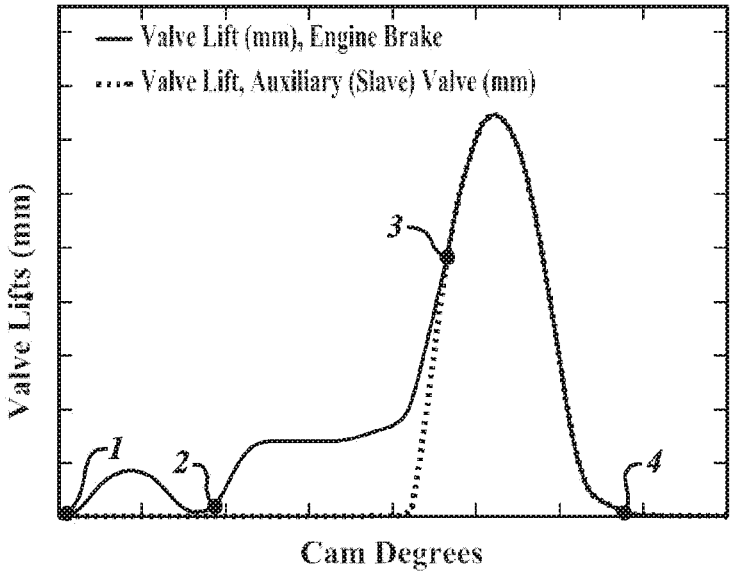
FIG. 3 is a plot showing typical exhaust valve lift shape for a one-by-one valve, decompression engine brake, and key points.
Figure 4:
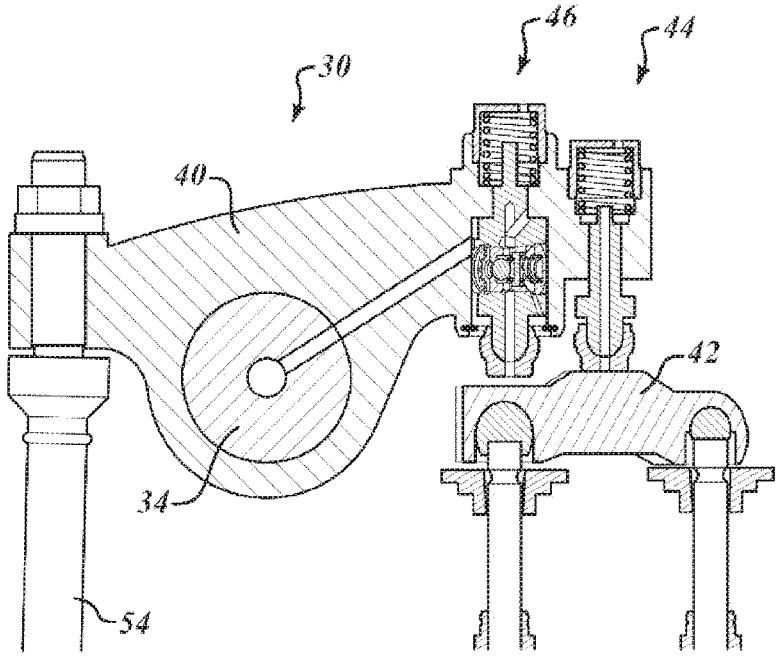
FIG. 4 is a schematic illustration of the exhaust valve rocker arm assembly of FIG. 2 and shown in position 1 of FIG. 3 and in positive power mode with the engine brake capsule disconnected.

With further reference now to FIGS. 2 and 3, an exhaust valve rocker arm assembly 30 will be further described. The exhaust valve rocker arm assembly 30 can generally include a rocker arm 40, a valve bridge 42, a spigot assembly 44 and a capsule assembly 46. The valve bridge 42 engages a first and second exhaust valve 50 and 52 (FIG. 2) associated with a cylinder of an engine. The first and second exhaust valves 50 and 52 have a corresponding elephant foot or E-foot 50*a* and 52*a*. The E-feet 50*a* and 52*a* allow the valve bridge 42 to move without creating any side load on the corresponding valve stem 50 and 52. The E-foot 50*a* is spherical. The E-foot 52*a* is cylindrical. A pushrod 54 (FIG. 2) moves upward and downward based on a lift profile of a cam shaft. Upward movement of the pushrod 54 pushes the rocker arm 40 and in turn causes the rocker arm 40 to rotate clockwise around the rocker shaft 34.

Figure 5:
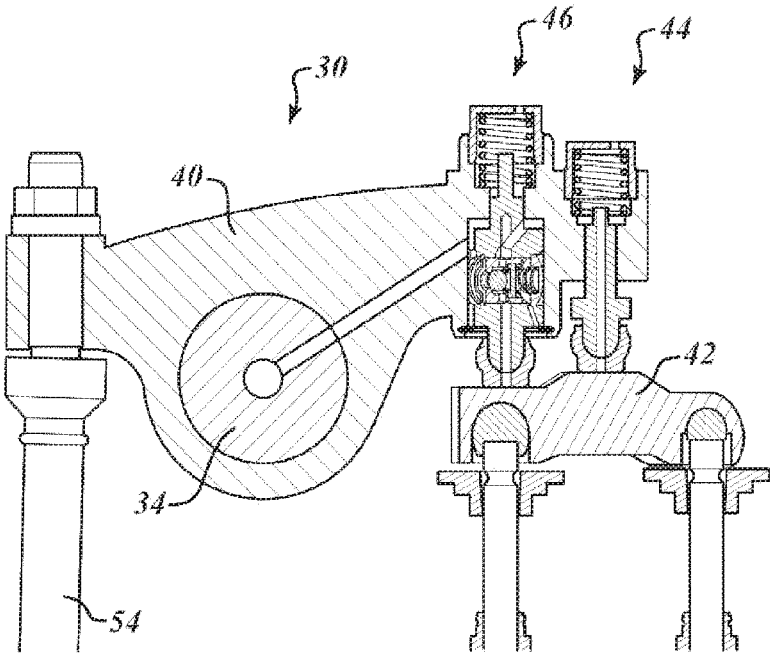
FIG. 5 is a schematic illustration of the exhaust valve rocker arm assembly of FIG. 2 and shown in position 1 of FIG. 3 and in engine brake mode with the engine brake capsule expanded and in contact with the bridge.
Figure 6:
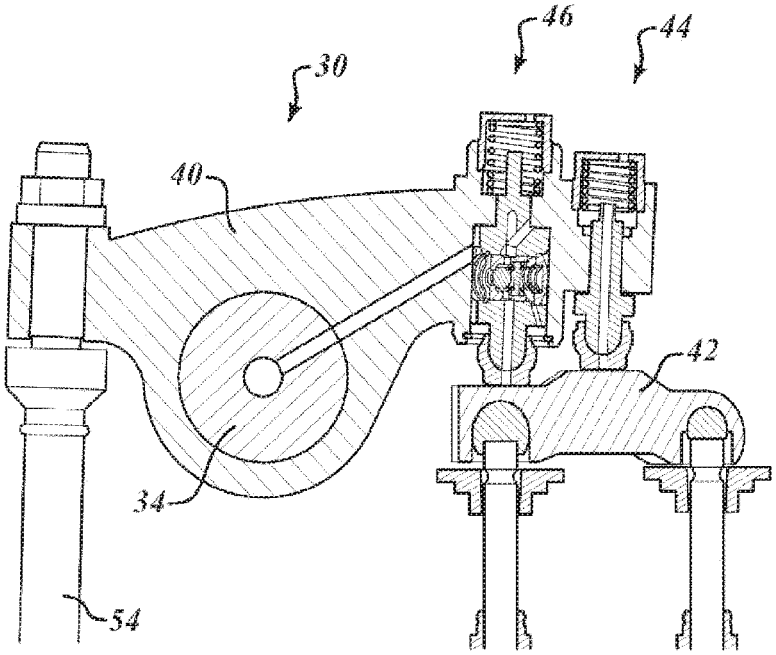
FIG. 6 is a schematic illustration of the exhaust valve rocker arm assembly of FIG. 2 and shown in position 4 of FIG. 3 for both drive mode and engine brake mode.
Figure 7:
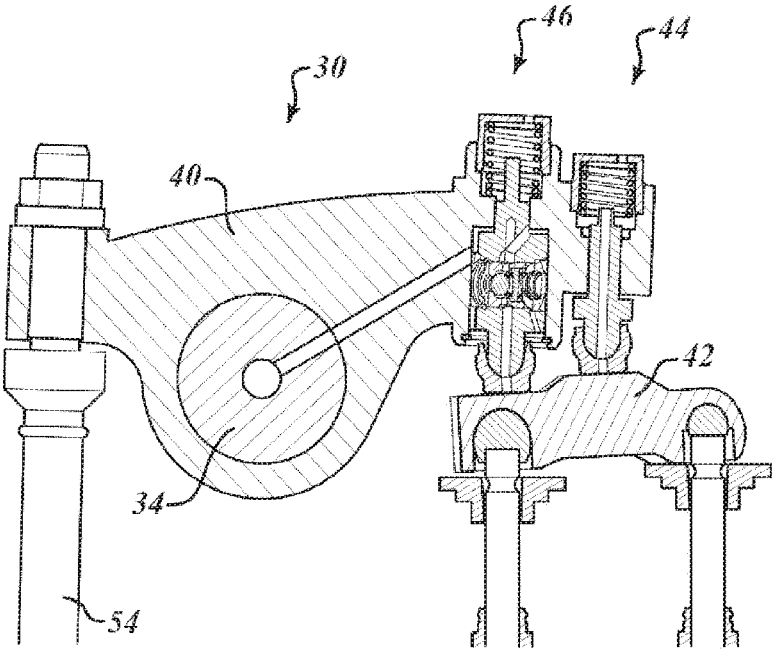
FIG. 7 is a schematic illustration of the exhaust valve rocker arm assembly of FIG. 2 and shown during brake valve lift between positions 1 and 2 and positions 2 and 3 of FIG. 3 with the engine brake capsule enabled to provide extended one-valve lift.
Figure 8:
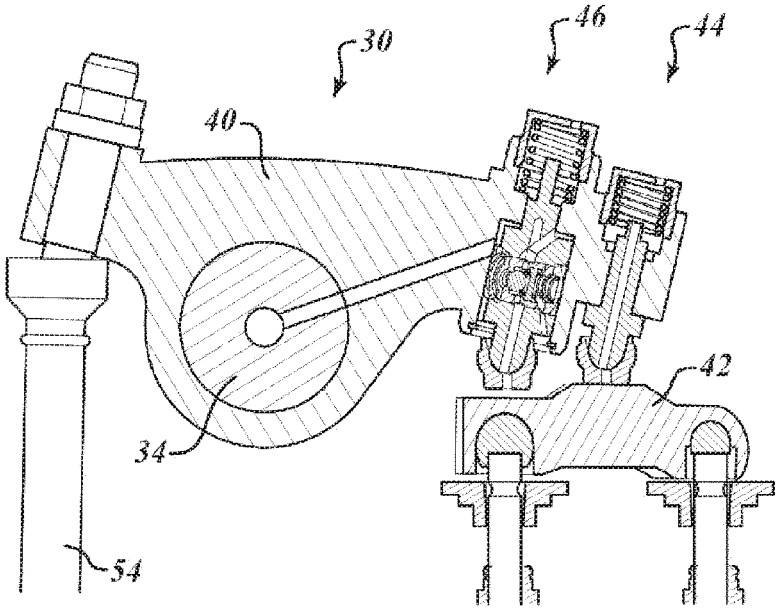
FIG. 8 is a schematic illustration of the exhaust valve rocker arm assembly of FIG. 2 and shown in position 3 in FIG. 3 shown with the engine brake capsule disconnected from the bridge.
Figure 9:
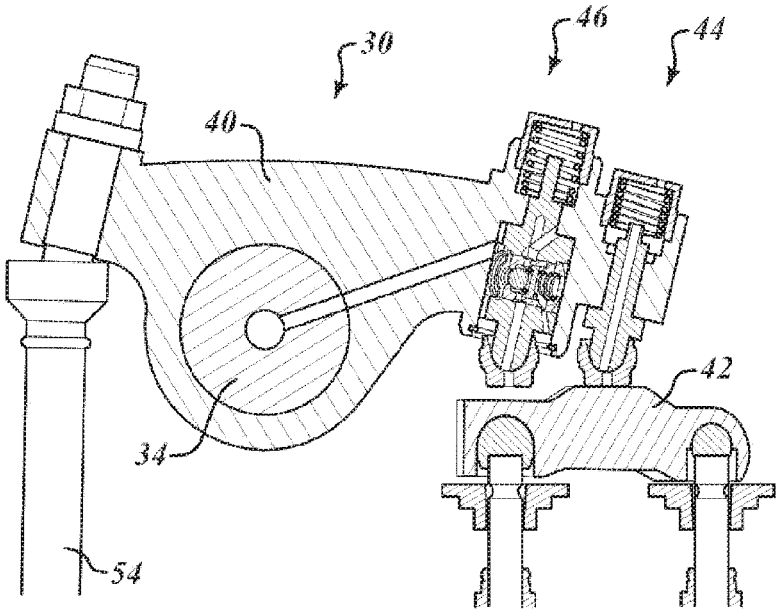
FIG. 9 is a schematic illustration of the exhaust valve rocker arm assembly of FIG. 2 and shown between position 3 and 4 in FIG. 3 shown with the engine brake capsule back in a compressed position and disconnected from the bridge.
Figure 16:
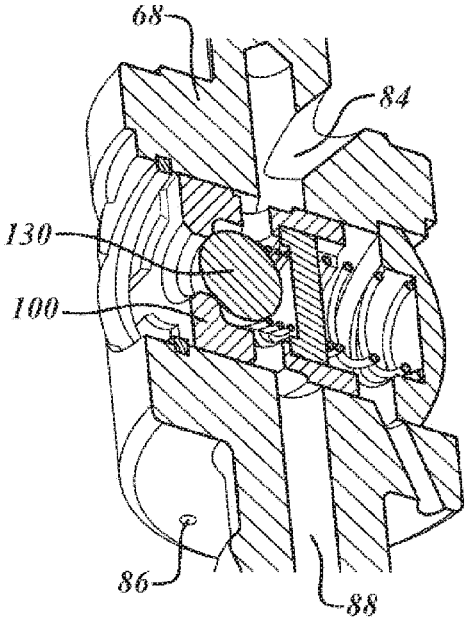
FIG. 16 is a sectional view of the shift assembly of FIG. 15 illustrating the leakage channel.
Figure 17:
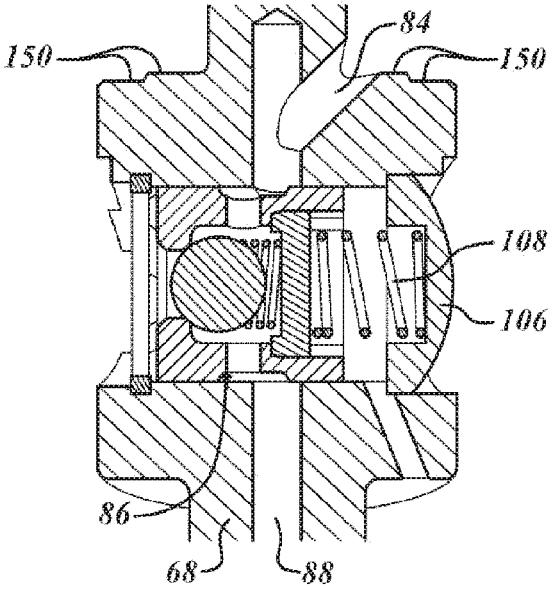
FIG. 17 is another sectional view of the shift assembly of FIG. 16 illustrating the upper surface.

With additional reference to FIGS. 10-14, the capsule assembly 46 will be further described. The capsule assembly 46 can generally be received in a chamber 60 defined in the rocker arm 40. A retaining ring 62 (FIG. 14) can trap the capsule assembly 46 in the chamber 60 of the rocker arm 40 and generally limit travel of the capsule assembly 46 in an extended position (see for example FIG. 5). The capsule assembly 46 can generally include a capsule body 68 and a shift assembly 70. The capsule body 68 (FIG. 10) can extend between a capsule ball end 76 and a stem end 78. A capsule recirculation groove 80 (FIG. 11) is defined around the capsule body 68. The capsule body 68 can further provide a shift assembly pocket 82 (FIG. 10) that receives the shift assembly 70. The shift assembly 70 can be retained in the shift assembly pocket 82 by a snap ring 83. A capsule channel 84 can extend from the shift assembly pocket 82 to an outer surface of the capsule body 68. A leakage channel 86 (FIGS. 16 and 17) is defined from the shift assembly pocket 82 to an outer surface of the capsule body 68. A capsule ball end passage 88 can extend from the shift assembly pocket 82 to an outer surface of the capsule body 68 at the capsule ball end 76.

Figure 10:
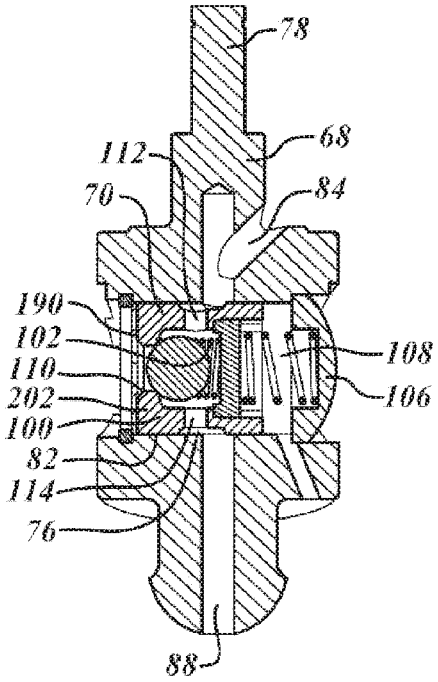
FIG. 10 is sectional view of the engine brake capsule according to the present disclosure.
Figure 15:
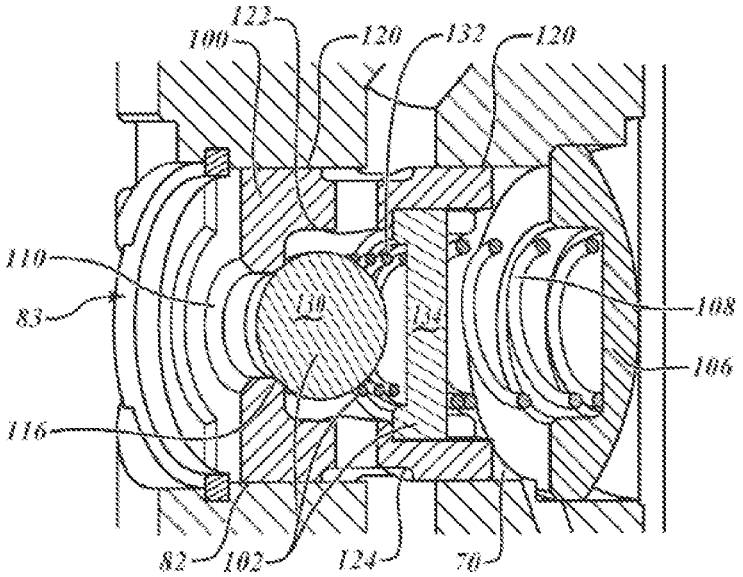
FIG. 15 is a sectional view of a shift assembly of the engine brake capsule of FIG. 14.

With particular reference to FIGS. 10 and 15, the shift assembly 70 will now be described in greater detail. The shift assembly 70 includes a shift body 100, a check ball valve assembly 102, a shield 106 and a return spring 108. The shift body 100 defines a port 110, a first passage 112 and a second passage 114. The port 110 can lead to a valve seat surface 116. Cylindrical lands 120 can be provided on the shift body 100 around the first and second passages 112, 114. The port 110, first passage 112 and the second passage 114 all lead to a shift body chamber 122. A shift body recirculation groove 124 is provided on the shift body 100. The shift body recirculation groove 124 is sealed from external environment by the cylindrical lands 120 with proper finishing and radial lash with respect to a diameter of the shift assembly pocket 82 of the capsule body 68.

Figure 13:
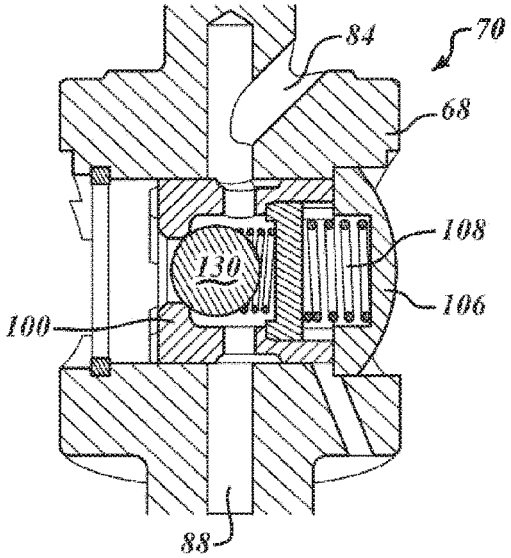
FIG. 13 is a detailed sectional view of the engine brake capsule of FIG. 10 and shown at a maximum pressure level.

As will become appreciated herein, the shift body 100 is caused to move between a first shift position A (FIG. 12) and a second shift position B (FIG. 13). The first shift position A corresponds to a pressure force that is lower than a force of the return spring 108. The second shift position B corresponds to a pressure force that is greater than a compressed load of the return spring 108. The return spring 108 seats on the shield 106 setting the spring installed length and the maximum stroke of the shift assembly 70.

The check ball valve assembly 102 generally includes a check ball 130, a check valve spring 132 and a plug 134. The check ball 130 is normally urged against the valve seat surface 116 by the check valve spring 132. The plug 134 is fixedly received in the shift body 110 and generally provides a barrier between the check valve spring 132 and the return spring 108.

Figure 14:
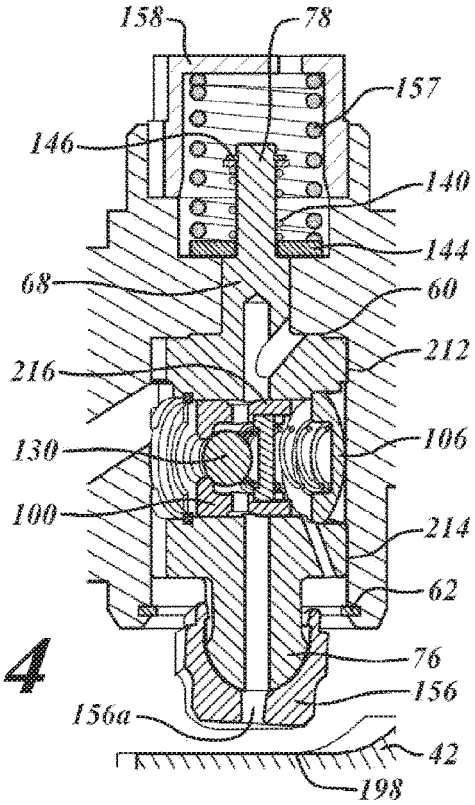
FIG. 14 is another sectional view of the engine brake capsule shown in FIG. 10.

With particular reference now to FIG. 14, additional features of the exhaust valve rocker arm assembly 30 will be described. The rocker arm 40 further includes a pulling spring 140 mounted generally around the stem end 78 of the capsule body 68. The pulling spring 140 acts between a mounting ring 144 and a snap ring 146. The pulling spring 140 generally keeps the capsule body 68 in a packed position (FIG. 14). The pulling spring 140 provides an installed load higher than the pressure load on surface 150 (FIG. 17) of the capsule body 68 when control pressure is at its minimum level. As a consequence, a capsule foot 156 having a foot passage 156*a* will not come in contact with the valve bridge 42 except at point 4 (FIG. 3) at the end of the valve closing event as will be described more fully below. A relief spring 157 is arranged between a first cap 158 and the mounting ring 144.

The spigot assembly 44 will be described in greater detail. The spigot assembly 44 can generally include a spigot body 162 having a distal end that is received by a spigot foot 164 and a proximal end that extends into a spigot bore 166 defined in the rocker arm 40. A collar 168 can extend from an intermediate portion of the spigot body 162. The spigot body 162 can extend through a passage 170 formed through the rocker arm 40. A second cap 172 is fixed to the rocker arm 40 at the spigot bore 166 and captures a biasing member 174 therein. The biasing member 174 acts between the second cap 172 and a snap ring 178 fixed to the proximal end of the spigot body 162. As will be described, the spigot body 162 remains in contact with the valve bridge 42 and is permitted to translate along its axis within the passage 170.

According to the present disclosure, the exhaust valve rocker arm assembly 30 according to the present disclosure provides an engine brake capsule assembly 46 that is normally compressed. Expansion of the capsule body 68 is dependent upon both the control pressure level (for example from a solenoid valve) and its contact with the valve bridge 42. During normal power mode, the capsule body 68 is normally collapsed in order to avoid contact with the valve bridge 42 during a valve event. FIG. 3 illustrates a typical exhaust valve lift shape for one-by-one valve decompression brake. Contact is limited to a single point 4 (FIG. 3) during rotation of the cam. During an engine brake event, the capsule body 68 is able to expand in order to provide a full braking event. Once contact with the bridge 42 is missed, the capsule body 68 collapses in order to remove any obstacle to the valve closing event.

Figure 11:
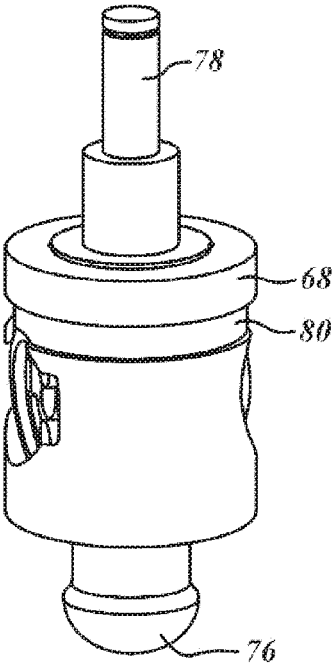
FIG. 11 is a side perspective view of the engine brake capsule of FIG. 10.
Figure 12:
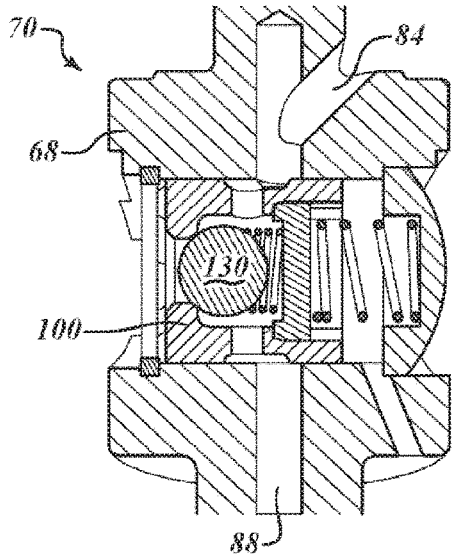
FIG. 12 is a detailed sectional view of the engine brake capsule of FIG. 10 and shown at a minimum pressure level.

The capsule assembly 46 is fed oil when a pressurized oil supply conduit or connecting passage 180 on the rocker shaft 34 aligns with an oil supply passage 182 defined in the rocker arm 40. The connecting passage 180 and the oil supply passage 182 are collectively referred to as an oil supply circuit 186. Explained further, as the rocker arm 40 rotates around the rocker shaft 34, the oil supply passage 182 will align with the connecting passage 180 allowing oil to flow into the recirculation groove 80 (FIG. 11). Sealing lands with proper finishing and radial lash are provided on both sides of the capsule recirculation groove 80 between the capsule body 68 and the chamber 60 of the rocker arm 40.

Oil pressure acting on surface 190 (FIG. 10) of the shift body 100 regulates the shift positions of the shift assembly 70 between the position A (FIG. 12) and the position B (FIG. 13). When control pressure is at a minimum level (it may be controlled by a solenoid oil control valve), the shift assembly 70 assumes position A (FIG. 12) for positive power stroke. It is kept at position A by the return spring 108 and the snap ring 83. With the shift body 100 in position A (FIG. 12), the leakage channel 86 (FIG. 16) is always open so any low level pressure acting in chamber 60 is dumped to the cylinder head through the capsule channel 84 and chamber 122 (FIG. 15). The pulling spring 140 keeps the capsule in the packed position.

When the valve train comes to point 4 (FIG. 3), the capsule ball end passage 88 is sealed by the contact with the valve bridge 42. In this regard, the foot passage 156*a* of the foot 156 is blocked by an upper surface 198 (FIGS. 2 and 14) on the valve bridge 42. The leakage channel 86 remains open allowing the capsule body 68 to compress into the chamber 60 as a result of the contact with the valve bridge 42 and letting residual oil out. The residual compression of the capsule body 68 is regulated by the relief spring 157 which dampens any over load to the capsule body 68 during contact at point 4 (FIG. 2).

When control pressure is at a maximum level, the shift assembly 70 assumes the position B (FIG. 13) in engine brake mode. The shift assembly 70 is pushed by the control pressure, acting on surface 202 (FIG. 10) and the return spring 108 is consequently compressed. The leakage channel 86 is closed by the cylindrical lands 120. When the shift body 100 reaches position B, the check ball valve assembly 102 opens letting oil flow through the port 110 and into the chamber 122 and the capsule channel 84 and the capsule ball end passage 88. During the whole cam turn, except for point 4 (FIG. 2), the capsule ball end passage 88 is fully open so the pressure inside the chamber 60 is dumped to the cylinder head and the capsule body 68 cannot expand. When the valve train comes to point 4, the capsule channel 84 is sealed by the contact among the valve bridge 42, the foot 156 and the capsule ball end 76. As a result, starting from point 4, the oil can flow through the check ball valve assembly 102 and it is trapped into the chamber 60. From point 4 to point 1, unless the contact among the valve bridge 24, the foot 156 and the capsule ball end 76 is missed, the pressure force acting on the surface 150 (FIG. 17) can expand the capsule assembly 46 until its working position at point 1 of the cam lift. The pulling spring 140 is designed so that when the capsule body 68 assumes it fully expanded position, its pulling load is lower than the pressure force acting on the surface 150. The capsule extended position may be ruled by mounting ring 144 installed in the rocker arm 40.

From point 1 to 3 of the valve lift, the capsule body 68 keeps it extended position, due to the following factors: (a) the control pressure acting on the surface 150, (b) the check ball valve assembly 102 not allowing oil return; and (c) the foot 156 acting as a sealing for the capsule ball end passage 88 against the valve bridge 42. From point 1 to 3 of valve lift, the extended capsule body 68 is loaded because of the single engine brake valve opening. In such conditions, the oil contained by chamber 60, shift body chamber 122, capsule channel 84, the capsule ball end passage 88 is trapped within the capsule because the check ball valve assembly 102 acts as a non-return valve for the oil volume inside the capsule. As a consequence, oil can only leak through the tight clearances 212, 214 and 216. In this regard, the capsule body 68 acts as a strong dampening element from cam lift points 1 to 3 and the desired engine brake valve lift may be performed.

According to the geometry of the rocker arm 40 and the valve train, there may be a point 3 of the cam lift, at which the contact between the valve bridge 42 and the foot 156 is missed, thus letting the capsule to discharge oil through the capsule ball end passage 88 to the cylinder head. As a result, from point 3 to point 4, the capsule assembly 40 may assume its normally compressed configuration, thus avoiding excessive flow forces due to the capsule compression point 4, which may affect the closing velocity of the two exhaust valves.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. An exhaust valve rocker arm assembly operable in a combustion engine mode and an engine braking mode, the exhaust valve rocker arm assembly comprising:

a rocker shaft that defines a pressurized oil supply conduit;

a rocker arm that receives the rocker shaft and is configured to rotate around the rocker shaft, the rocker arm having an oil supply passage defined therein;

a valve bridge that engages a first exhaust valve at a first foot and a second exhaust valve at a second foot;

a capsule assembly disposed on the rocker arm having a capsule body that is configured to move between a first capsule position and a second capsule position, wherein, in the first capsule position, the capsule body is in a retracted position in the rocker arm offset from the valve bridge, wherein, in the second capsule position, the capsule body extends rigidly for cooperative engagement with the valve bridge;

a pulling spring configured to normally bias the capsule body to the retracted position; and a shift assembly disposed in the capsule assembly and having a shift body configured to move between first and second shift positions, the first shift position corresponding to the capsule body in the first capsule position, the shift body having a shift body chamber that houses a check ball valve assembly, the shift body configured to move from the first shift position to the second shift position in engine brake mode upon opening of the check ball valve assembly, wherein, in the engine braking mode, pressurized oil is communicated through the oil supply passage and against the shift body such that the shift body moves from the first shift position to the second shift position.

2. The exhaust valve rocker arm assembly of claim 1, wherein the capsule body extends between a capsule ball end and a stem end, the capsule body defining a shift assembly pocket that receives the shift assembly therein.

3. The exhaust valve rocker arm of claim 2, wherein the capsule body further defines (i) a capsule channel that extends from the shift assembly pocket to an outer surface of the capsule body, and (ii) a capsule ball end passage that extends from the shift assembly pocket to an outer surface of the capsule body.

4. The exhaust valve rocker arm of claim 3, wherein the check ball valve assembly includes a check hail and a check valve spring, wherein the check ball is configured to be urged against a valve seat surface provided around a port on the shift body by the check valve spring.

5. The exhaust valve rocker arm of claim 4, wherein, upon opening of the check ball assembly, the check ball is configured to be moved off of the valve seat such that oil flows through the port and into the capsule channel and the capsule ball end passage.

6. The exhaust valve rocker arm of claim 5, wherein oil pressure acting on an outer surface of the shift body proximate the port urges the shift body to move from the first shift position to the second shift position.

7. The exhaust valve rocker arm of claim 3, wherein the capsule body further defines a leakage channel that extends from the shift assembly pocket to an outer surface of the capsule body.

8. The exhaust valve rocker arm of claim 7, wherein, when the shift body is in the first shift position, low pressure oil acting in the shift body chamber exits through the leakage channel.

9. The exhaust valve rocker arm of claim 1, further comprising a spigot assembly having a spigot body that extends through a passage firmed through the rocker arm, wherein the spigot body is biased into engagement with the valve bridge and is permitted to translate along an axis thereof within the passage.

10. An exhaust valve rocker arm assembly operable in a combustion engine mode and an engine braking mode, the exhaust valve rocker arm assembly comprising:

a rocker shaft that defines a pressurized oil supply conduit;

a rocker arm that receives the rocker shaft and is configured to rotate around the rocker shaft, the rocker arm having an oil supply passage defined therein;

a valve bridge that engages a first exhaust valve at a first foot and a second exhaust valve at a second foot;

a capsule assembly disposed on the rocker arm having a capsule body that is configured to move between a first capsule position and a second capsule position, wherein, in the first capsule position, the capsule body is in a normally retracted position in the rocker arm offset from the valve bridge, wherein, in the second capsule position, the capsule body extends rigidly for cooperative engagement with the valve bridge; and a shift assembly disposed in the capsule assembly and comprising:

a shift body configured to move between first and second shift positions, the first shift position corresponding to the capsule body in the first capsule position, the shift body having a shift body chamber;

a check ball valve assembly received in the shift body chamber, the shift body configured to move from the first shift position to the second shift position in engine brake mode upon opening of the check ball valve assembly; and a return spring configured to bias the shift body toward the first shift position, wherein, in the engine braking mode, pressurized oil is communicated through the oil supply passage and against the shift body such that the shift body moves from the first shift position to the second shift position.

11. The exhaust valve rocker arm assembly of claim 10, further comprising:

a pulling spring configured to normally bias the capsule body to the retracted position.

12. The exhaust valve rocker arm assembly of claim 10, wherein the capsule body extends between a capsule ball end and a stem end, the capsule body defining a shift assembly pocket that receives the shift assembly therein.

13. The exhaust valve rocker arm of claim 12, wherein the capsule body further defines (i) a capsule channel that extends from the shift assembly pocket to an outer surface of the capsule body, and (ii) a capsule ball end passage that extends from the shift assembly pocket to an outer surface of the capsule body.

14. The exhaust valve rocker arm of claim 13, wherein the check ball valve assembly includes a check ball and a check valve spring, wherein the check ball is configured to be urged against a valve seat surface provided around a port on the shift body by the check valve spring.

15. The exhaust valve rocker arm of claim 14, wherein the shift body defines a shift body recirculation groove that leads to a first passage and a second passage extending into the shift body chamber, wherein the capsule channel, the first passage, the second passage, and the capsule ball end passage are all fluidly connected.

16. The exhaust valve rocker arm of claim 15, wherein oil pressure acting on an outer surface of the shift body proximate the port urges the shift body to move from the first shift position to the second shift position, wherein upon opening of the check ball assembly, the check ball is configured to be moved off of the valve seat such that oil flows through the port and into the capsule channel and the capsule ball end passage.

17. The exhaust valve rocker arm of claim 13, wherein the capsule body further defines a leakage channel that extends from the shift assembly pocket to an outer surface of the capsule body.

18. The exhaust valve rocker arm of claim 17, wherein, when the shift body is in the first shift position, low pressure oil acting in the shift body chamber exits through the leakage channel.

19. The exhaust valve rocker arm of claim 10, further comprising a spigot assembly having a spigot body that extends through a passage formed through the rocker arm, wherein the spigot body is biased into engagement with the valve bridge and is permitted to translate along an axis thereof within the passage.

* * * * *